United States Patent [19]

Hughes et al.

[11] 4,312,552

[45] Jan. 26, 1982

[54] CROSS CONNECT APPARATUS

[75] Inventors: Richard L. Hughes; Ned A. Sigmon, both of Clemmons, N.C.

[73] Assignee: AMP Incorporated, Harrisburg, Pa.

[21] Appl. No.: 149,777

[22] Filed: May 15, 1980

[51] Int. Cl.[3] ..... H01R 13/44; H01R 9/00

[52] U.S. Cl. ..... 339/36; 339/198 J; 174/59; 361/426

[58] Field of Search ..... 339/36, 198 J; 174/59, 174/60; 361/426, 356, 364

[56] References Cited

U.S. PATENT DOCUMENTS

| | | | |
|---|---|---|---|
| 2,106,003 | 1/1938 | Hewitt | 361/356 X |
| 2,317,450 | 4/1943 | Folds et al. | 174/60 |
| 3,479,104 | 11/1969 | Kobryner | 361/364 X |
| 4,141,618 | 2/1979 | Reavis et al. | 339/97 P |

OTHER PUBLICATIONS

Gold Mine, Communication Apparatus Co. (Publication).

*Primary Examiner*—Joseph H. McGlynn
*Assistant Examiner*—Frank H. McKenzie, Jr.
*Attorney, Agent, or Firm*—Gerald K. Kita

[57] ABSTRACT

The terminal board and mounting frame are disclosed. Electrical terminals are arranged in rows and columns on the terminal board and are adapted for splicing or cross connecting high density communication wiring for communications, data processing, telemetry, signal control and broadcasting applications.

3 Claims, 9 Drawing Figures

Fig. 1
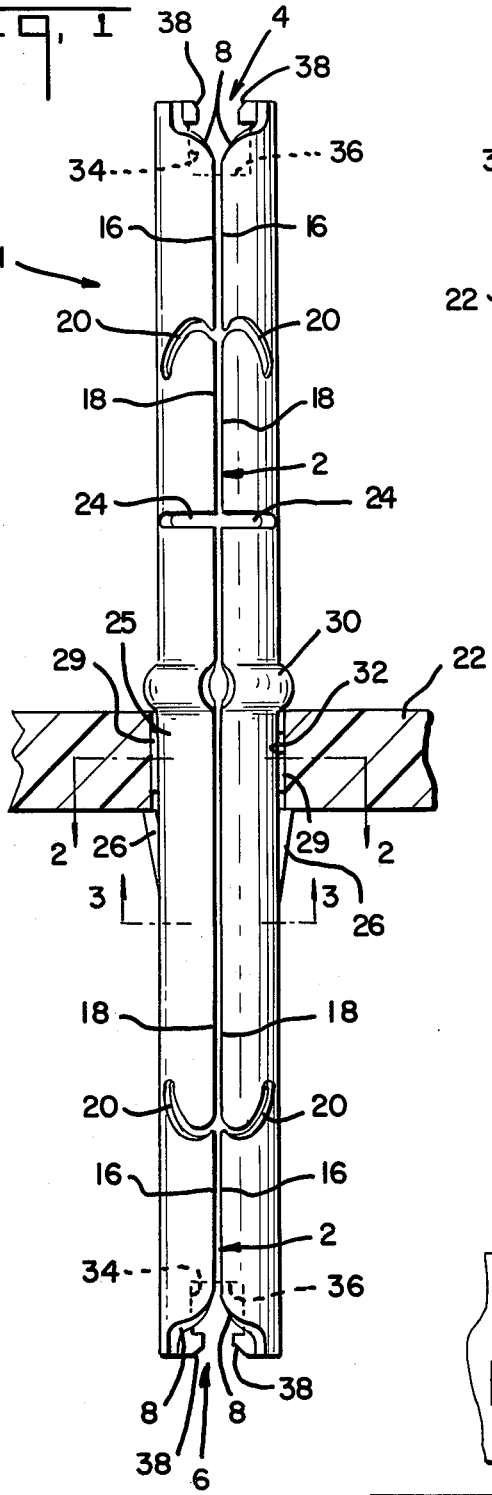
Fig. 2
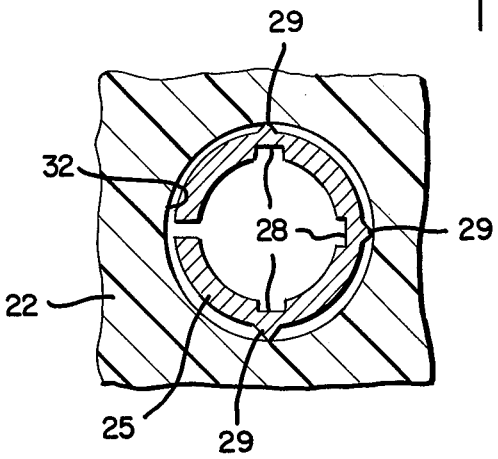
Fig. 3
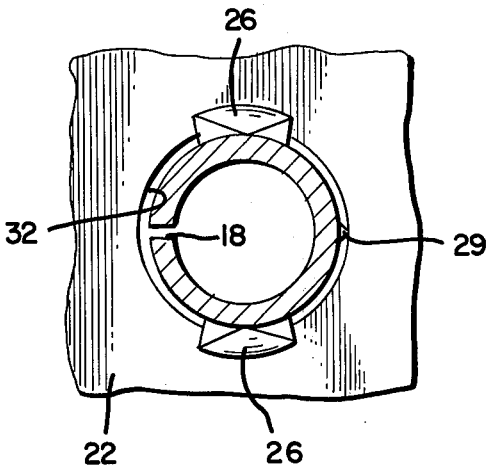
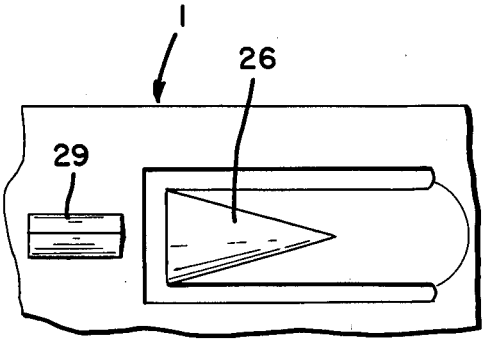
Fig. 4

CROSS CONNECT APPARATUS

FIELD OF THE INVENTION

The present invention relates to a cross connect apparatus in which large numbers of electrical terminals are mounted, and adapted to splice together the greatest number of electrical wires in the smallest space.

BACKGROUND OF THE PRIOR ART

A typical cross connect apparatus includes a panel on which are provided large numbers of electrical terminals. The terminals are arranged in columns and rows, closely spaced together. The terminals are used for splicing communication wiring, or for cross connecting the wiring of one cable with the corresponding wiring of one or more additional cables.

In one such apparatus, the terminals comprise internally threaded posts. Wire connections are made by stripping insulation off the ends of the wires, wrapping the exposed conductors around the shank of a screw and then threadably securing the screw tightly into the post.

Another cross connect apparatus comprises a terminal board having a plurality of posts which are hollow sockets. Wires are cross connected, by connecting a pin to each wire and then intermating the pin in a desired socket.

SUMMARY OF THE INVENTION

In the present invention, a circuit board is provided with electrical terminals in the form of longitudinally slotted barrels. Electrical connections are made by forcibly inserting one or more wires axially of their lengths along the slot of a barrel. During insertion each wire is forced over a cutting edge on the terminal, thus trimming the wire to length. Electrical connection is made without having to strip the wire. The slot is provided with tandem sections, tailored for the multiple functions of slicing the wire insulation, flattening the conductor and gathering strands of the conductor.

Multiple barrels are mounted in rows and columns in a terminal board. The barrels project outwardly from opposite sides of the board. Wires are connected to selected barrels on either side of the terminal board. An array of terminal boards are assembled together in a frame for splicing or cross connection high density communication wiring. Each terminal board is pivotally mounted by its frame, so that the sides of the terminal board may be pivoted to face outwardly from the terminal board array, and consequently be accessible for installation of wires. When installation is complete, the terminal board may be pivoted to return to its position in the array.

OBJECTS

An object of the invention is to provide a slotted barrel terminal which is self locking in a panel and which provides for electrical connection of one or more wires along a slot of the terminal which projects outwardly of a side of the panel.

Another object of the present invention is to provide a mounting frame for a terminal board which pivotally positions a terminal board for wire installation on either side thereof.

Other objects and advantages of the present invention will become apparent from the following detailed description taken in conjunction with the drawings.

DRAWINGS

FIG. 1 is an enlarged elevation of a terminal according to the present invention mounted in a panel or terminal board.

FIG. 2 is a section taken along the line 2—2 of FIG. 1.

FIG. 3 is a section taken along the line 3—3 of FIG. 1.

FIG. 4 is a fragmentary plan view of a lance portion of the terminal of FIG. 1.

DETAILED DESCRIPTION OF THE DRAWINGS

Figure 5:
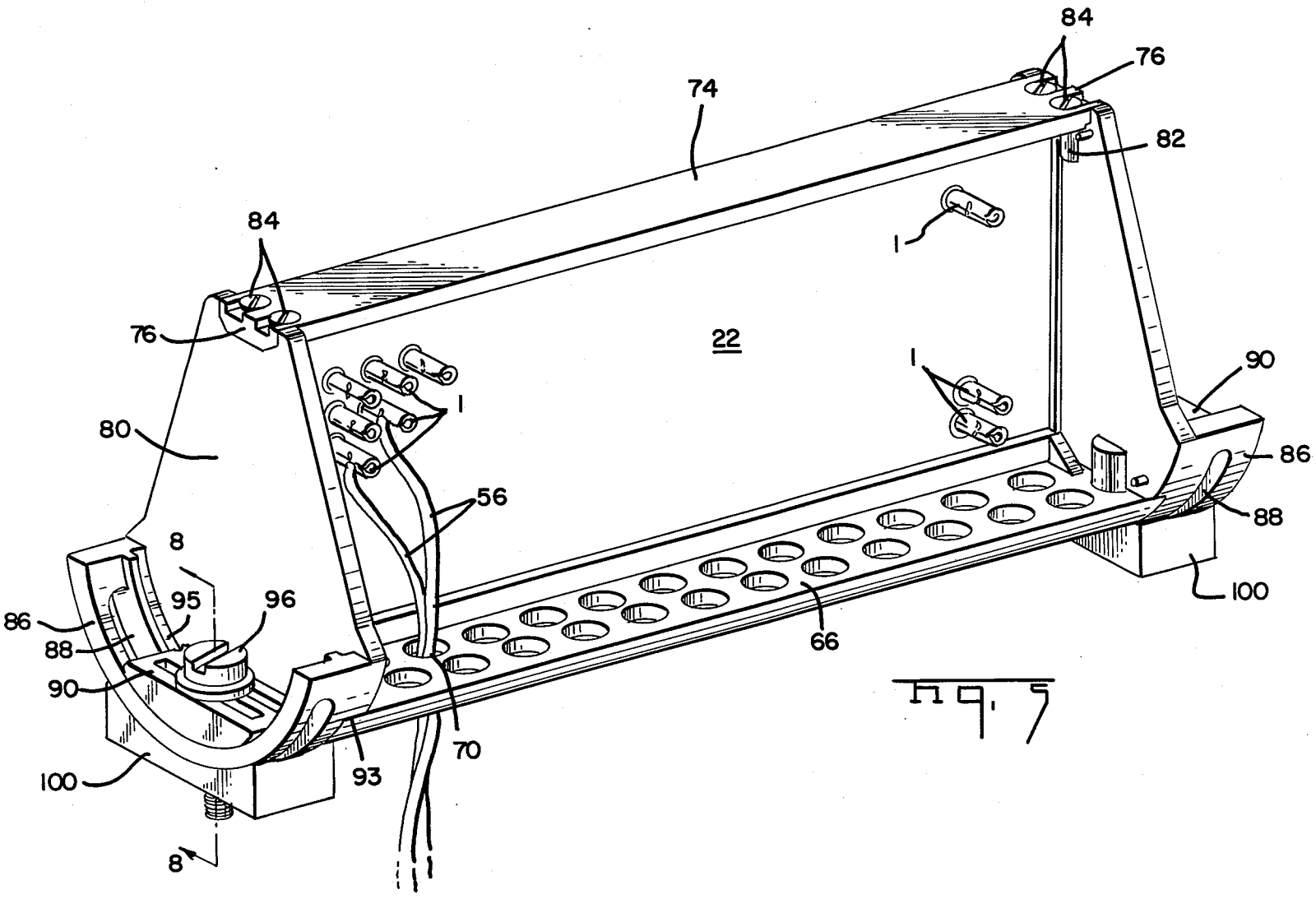
FIG. 5 is an enlarged perspective of a wiring module.
Figure 6:
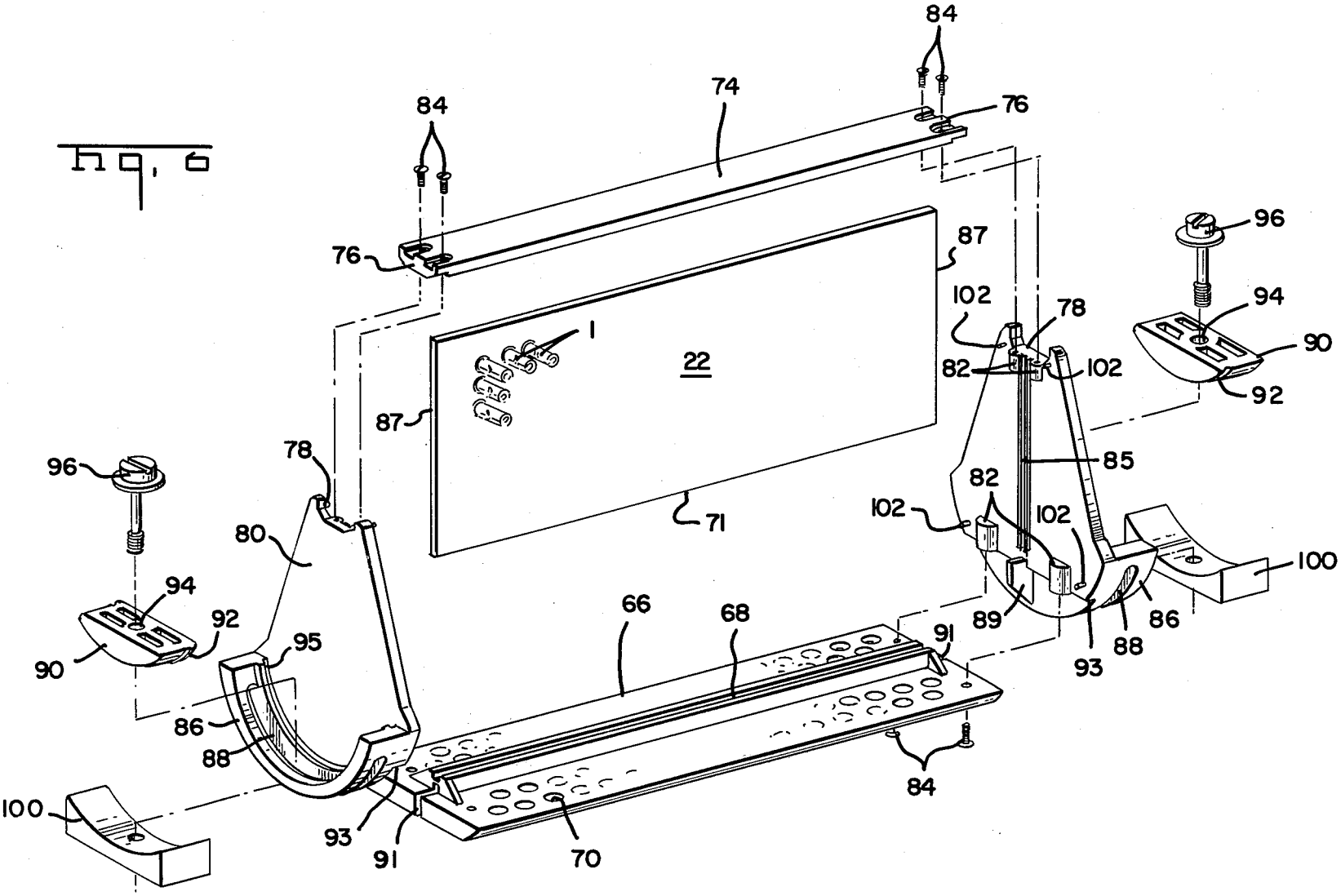
FIG. 6 is a perspective with parts in exploded configuration of the module shown in FIG. 5.

FIGS. 1-4 illustrate a barrel shaped terminal 1, formed from a flat blank rolled into a tubular barrel or sleeve configuration having a longitudinal open seam 2 in which one or more wires are to be connected. Adjacent each open end 4 and 6 of the terminal, the seam is provided with a pair of diagonally converging cutting edges 8 communicating with the open end 4 or 6 of the terminal and merging with opposite edges of the seam 2. Another, tandem, section of the seam 2 is provided by closely spaced apart axially aligned edges 16. Another tandem section of the seam 2 is provided by spaced apart edges 18. A transverse slot 20 intersects the same and separates the edges 16 from the edges 18.

The edges 8 are inclined from the axis of the seam 2. A range of insulated wire sizes, or diameters, may be terminated in the seam 2. The width of the seam separating the edges 8 tapers to compress across the diameter of the conductor portion of an insulated wire. It is noted that insertion of an insulated wire within the seam section will open the seam slightly, although excessive opening is resisted by resiliency in the terminal. As a wire is inserted into the seam section the edges 8 will slice through the insulation on the insulated wire. In addition, the angle provided on the edges 8 will apply compression loading on opposite sides of any conductor within the range. If the conductor is stranded wire, the strands will tend to be gathered by the edges 8. Further insertion of an insulated wire along the seam 2 will cause the wire to enter the seam section defined between the edges 16. The tapered width at the beginning of the seam section between the edges 16 provide compression lead-in surfaces to indent opposite sides of a conductor portion of an insulated wire without cutting the strands of the wire or without cutting into a solid conductor. The edes 16 thereby deform or flatten the conductor from a circular diameter to an oblong shape, or elongated shape, and establish electrical with the elongated sides of the conductor, where insulation was previously sliced through by the edges along the seam. The wire then is forced along the seam into a seam section defined between conductor gripping edges 16 which engage the conductor portion of the inserted wire to establish the electrical connection. The edges 16 thereby provide jaws which are opened slightly by the presence of a conductor therebetween. Resiliency in the circular periphery of the terminal resiliently resists opening or separation of the jaws, and applies resilient compression on the conductor. A second set of resilient jaws 18 is provided by opposed edges 18 in another tandem section of the seam separated from the jaws 16 by an arcuate slot 20 which intersects the seam 2.

At the intersection of the edge 8 with the edge 16, a relatively sharp radius is provided to insure that the edge 8 will slice through the insulation of a wire of appropriate diameter, and to promote gathering individual strands of the conductor.

As shown in FIGS. 1, 2, and 3, the terminal 1 is adapted for insertion through the thickness of a panel or terminal board 22. FIG. 1 shows the terminal provided with aligned notches 24 which intersect the seam 2. A longitudinal section 25 of the terminal is defined between a notch 24 and a resilient finger 26 projecting as a cantilever beam longitudinally of the blank, spaced from the open seam 2. In order to improve the stiffness and strength of the fingers 26, they are forged by a coining operation, while the terminal is yet in the form of a flat blank, such that they become thinner but work hardened by the process, and are formed to diverge outward diagonally of the plane of the blank. One side of the blank is deeply indented at 28 to project metal outwardly from an opposite side of the blank, forming pointed ridges 29. The blank is then subjected to a forming operation to provide a radially outward bulged collar 30 as part of the terminal section 25. The blank is then rolled into the sleeve or barrel configuration such that the fingers 26 project radially outward and lie adjacent the section 25, now cylindrical. The collar 30 is suspended against the surface of the board 22. The notches 24 separate the wire receiving portion of the terminal from the section 25 which is inserted through an aperture 32 of the board. The fingers 26 are first deflected radially inward of the barrel as the same is inserted vertically into the aperture of the board 22 as viewed in FIG. 1. Subsequently, the fingers 26 spring radially outward to impinge against an under surface of the board. The ridges 29 project radially outward of the terminal and impinge against the sidewall of the aperture 32 to retain the terminal stably in position.

Further, as shown in FIGS. 1, 2, and 3, each end of the terminal is provided with a vertical rectangular notch 34 aligned with the seam 2 and having a chamfered chisel surface 36. Each margins 38 of the terminal on either side of the notch 34 are coined to increase the stiffness thereof. The edge margins overhang the notch 34 and provide a narrow entryway to the notch 36.

In operation, an insulated wire (not shown) is located in an open end of the barrel terminal 1. The wire is forced through the narrow entryway between the edges 38 to register within the notch 36. The remainder of the wire passes through the open seam 2 initially between the slicing edges 8. The wire is forced axially of its length along the successive or tandem sections of the seam 2 until the conductor is gripped between the wire gripping jaws 16. Further the portion of wire which projects through the notch 34 will be forced over the cutting edge 36 and cut off during insertion of the wire along the terminal.

An additional wire (not shown) may be connected to the terminal 1 similarly as the first wire. The additional wire is forced axially of its length along the open seam 2 of the terminal, and over the cutting edge 36. The wire engages the first wire and urges the same along the seam 2 in registration between the jaws 18 of the terminal 1. The wire connections are more specifically disclosed in U.S. Pat. No. 4,141,618.

Figure 7:
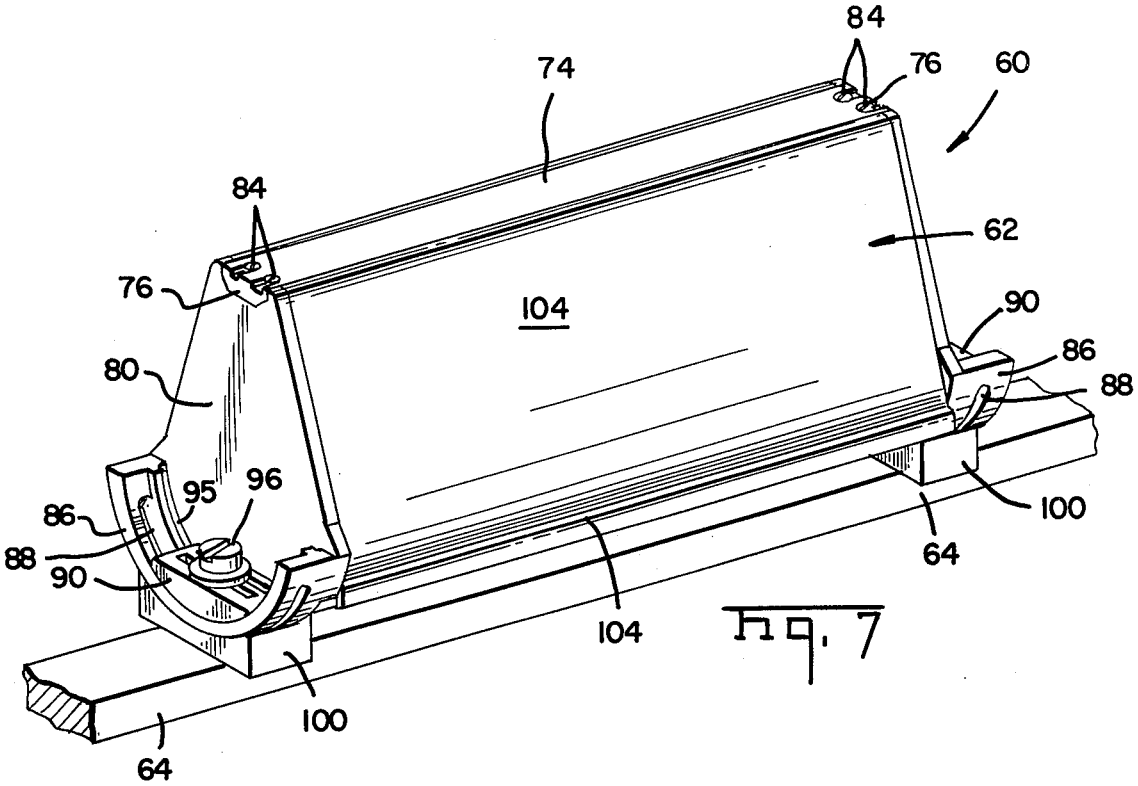
FIG. 7 is a fragmentary perspective of the wiring module of FIG. 5, assembled onto a cross connect apparatus.
Figure 8:
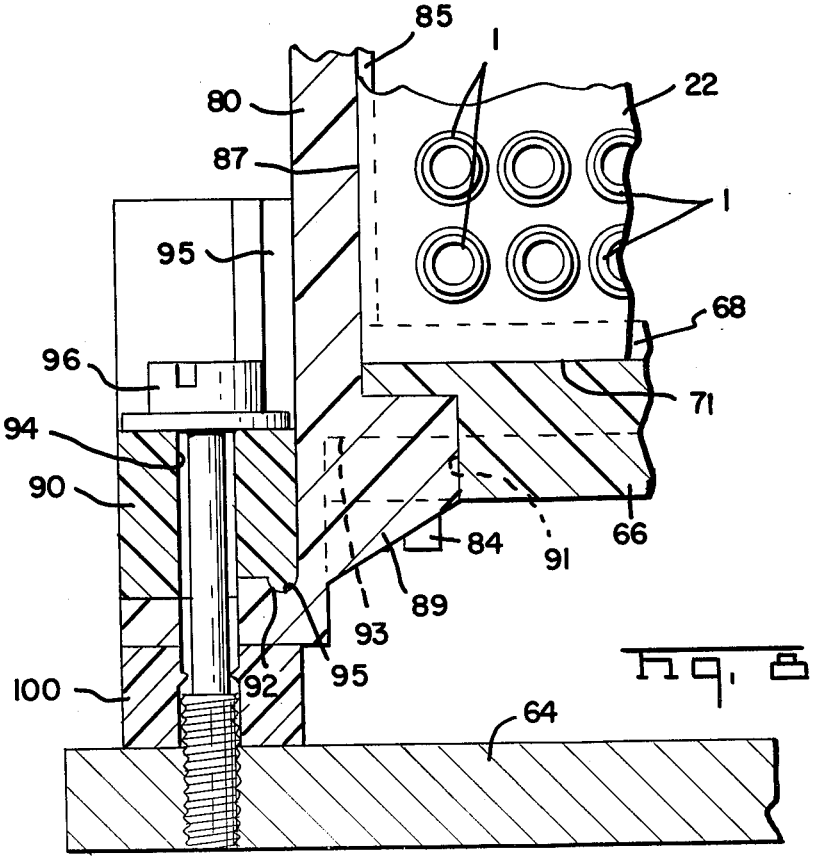
FIG. 8 is an enlarged fragmentary section taken along the line 8—8 of FIG. 5.
Figure 9:
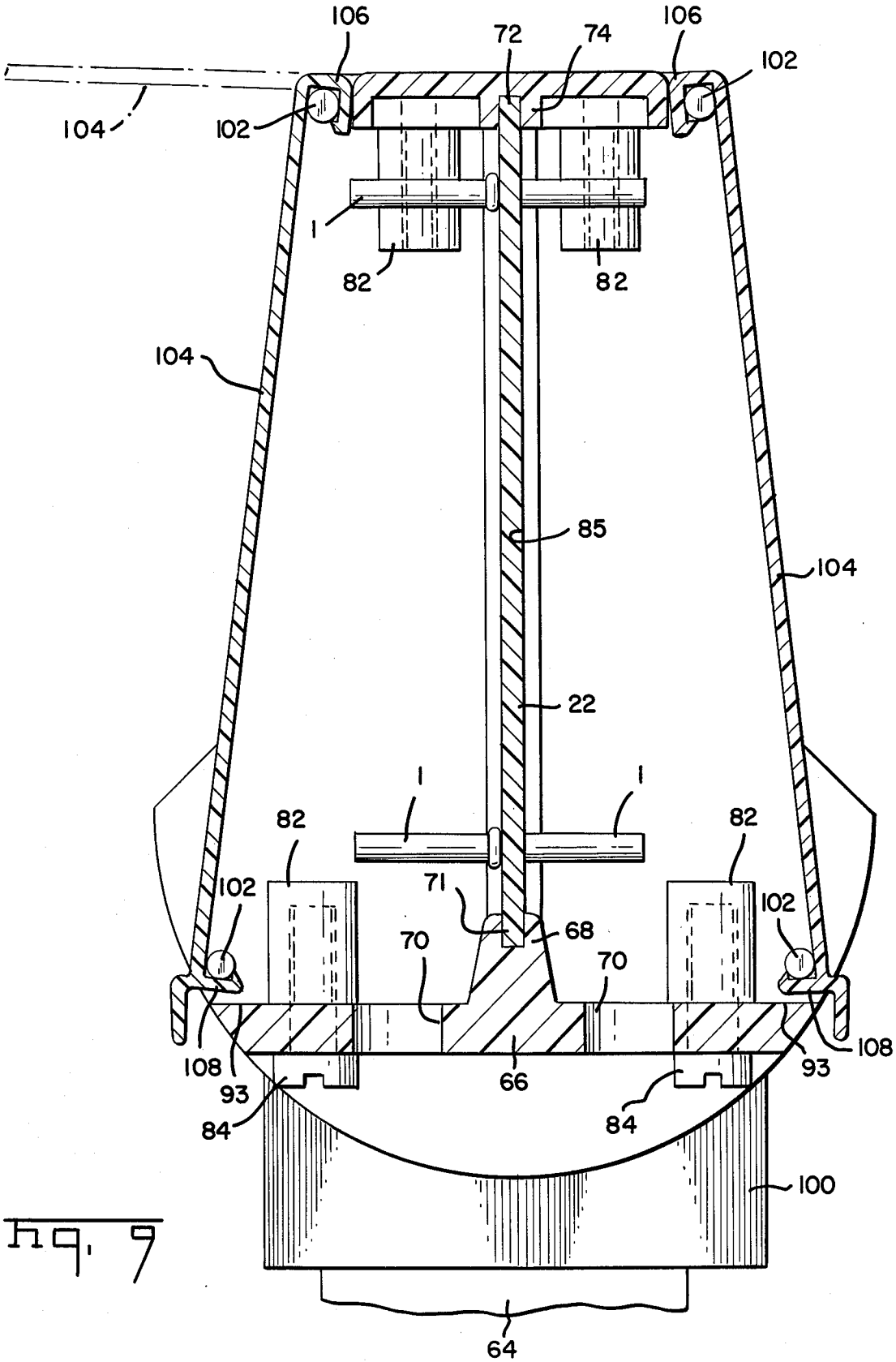
FIG. 9 is a section taken along the line 9—9 of FIG. 7.

FIG. 7 illustrates at 60 a cross connect system in which individual wiring modules 62 are secured to a rail 64. The details of a module are illustrated in FIGS. 5–9. Each module includes a molded base 66 having a central grooved channel 68 and wire dressing openings 70 through the base 66 on either side of the channel 68. The panel board 22, having a plurality of terminals 1 mounted in densely spaced columns and rows, has one of its edge margins 71 received in the rail 68. An opposite edge margin 72 is received in a molded grooved top channel 74. The ends 76 of the channel 74 interfit with open notches 78 provided in molded end walls 80. Each end wall 80 is molded from a rigid plastic material and provided with integral bosses 82 through which threaded fasteners 84 are mounted for securing the end wall to the channel end 76 and to the base 66 at an end of the channel 68. Each end wall includes a molded vertical grooved track 85 receiving an edge margin 87 of the board 22. A projecting rib 89 of each end wall, aligned with the track 85, interfits in a deep groove 91 in the base 66 aligned with the channel 68. An undercut shoulder 93 in each end wall 80, together with the bottom 5 of the respective bosses 82, seat against the base 66. Each end wall 80 is provided with an arcuate molded track 86 having a central slot 88. An arcuate mounting block 90 is provided with an arcuate projecting rib 92 which is slidably received in a groove 95 in the track 86. A vertical bore passes through the block intercepting the slot 88. An elongated bolt 96 passes freely along the bore 94, and through the slot 88 of a track 86. The bolt is threadably driven through a threaded shim block 100, and threadably secured in a mounting rail 64 to secure the module thereto. The shim blocks provide a clearance space between the base 66 and the rail 64 for the wires 56 to allow pivoting of the module 62 without pinching the wires passing through the clearance.

FIG. 5 illustrates communication wires 56 laced through selected openings 70 in the base 66 and then electrically connected or terminated to corresponding terminals 1 mounted on the board 22. Each wiring module 62 can be pivoted by movement of its tracks 88 along the mounting blocks 90 in order to swing the circuit board or panel board 22 to positions more accessible for lacing and terminating wires.

Each end block 80 is provided with projecting pins 102 for mounting cover panels 104. More specifically, each cover panel is molded with inverted hook portions 106 which hook over and hang from respective pins 102 which are adjacent the channel 74. The hook portions are then pivoted over the pins 102, until the shallow, hook shaped bottom edge 108 latchably engages the respective pins 102 adjacent the arcuate end of the end block. The terminals, and the terminated wiring is protected by the covers. Access to the terminals is obtained by unlatching and unhooking the covers from the pins.

Although a preferred embodiment of the present invention is disclosed, other embodiments and modifications thereof which would be apparent to one having ordinary skill is intended to be covered by the spirit and scope of the appended claims.

What is claimed is:

1. In a cross connect apparatus having electrical terminals arranged on opposite sides of a terminal board, and a frame for pivotably mounting the terminal board, the improvement comprising:

cover means for protecting the terminals and wiring connected thereto, said cover means having hook portions pivotably hooked over pins provided on said frame, and said cover means having hook shaped edges latchably engaging additional pins provided on said frame.

2. The structure as recited in claim 1, wherein, said frame includes arcuate end blocks mounting said frame, and shim blocks coupling said end blocks to the remainder of said cross connect apparatus.

3. The structure as recited in claim 1, wherein said frame further includes a base mounted to said end blocks and supporting an edge margin of said terminal board, said base including wire receiving openings for wires terminated to said terminals, and shim blocks supporting said end blocks and providing a clearance space adjacent said base for said wires.

* * * * *